United States Patent [19]

Charity

[11] 4,422,546

[45] Dec. 27, 1983

[54] SOAP DISH

[76] Inventor: Betty Charity, 8036 Lincoln Dr., Jessup, Md. 20794

[21] Appl. No.: 406,903

[22] Filed: Aug. 10, 1982

[51] Int. Cl.[3] ..... A47K 5/08; A47K 7/02; A47L 13/46; B43L 21/00

[52] U.S. Cl. ..... 206/77.1; 206/563; 15/244 C

[58] Field of Search ..... 206/77.1, 563, 557; 15/244 C, 244 R

[56] References Cited

U.S. PATENT DOCUMENTS

| | | | |
|---|---|---|---|
| 1,659,644 | 2/1928 | Vernet | 15/244 C |
| 1,748,406 | 2/1930 | Blair | 15/244 C |
| 1,756,713 | 4/1930 | Vernet | 15/244 C |
| 2,066,420 | 1/1937 | Reysa | 15/244 C |
| 2,722,719 | 11/1955 | Altstadter | 206/77.1 |

*Primary Examiner*—William T. Dixson, Jr.
*Attorney, Agent, or Firm*—Morton J. Rosenberg

[57] ABSTRACT

A soap dish (10) is provided for holding a bar of soap (12). The soap dish (10) is formed of a soap retaining member (14) which has formed therein a soap chamber (26) for receiving the soap bar (12). The soap retaining member (14) is formed of an aqueous absorbing composition which may be compressively deformed subsequent to absorption of soap drippings in order to allow removal of the liquid contained therein. The soap dish (10) provides for a soap bar which may be maintained in a dry state during prolonged non-use times of soap bar (12) and which has the effect of extending the useful lifetime of soap bar (12).

9 Claims, 4 Drawing Figures

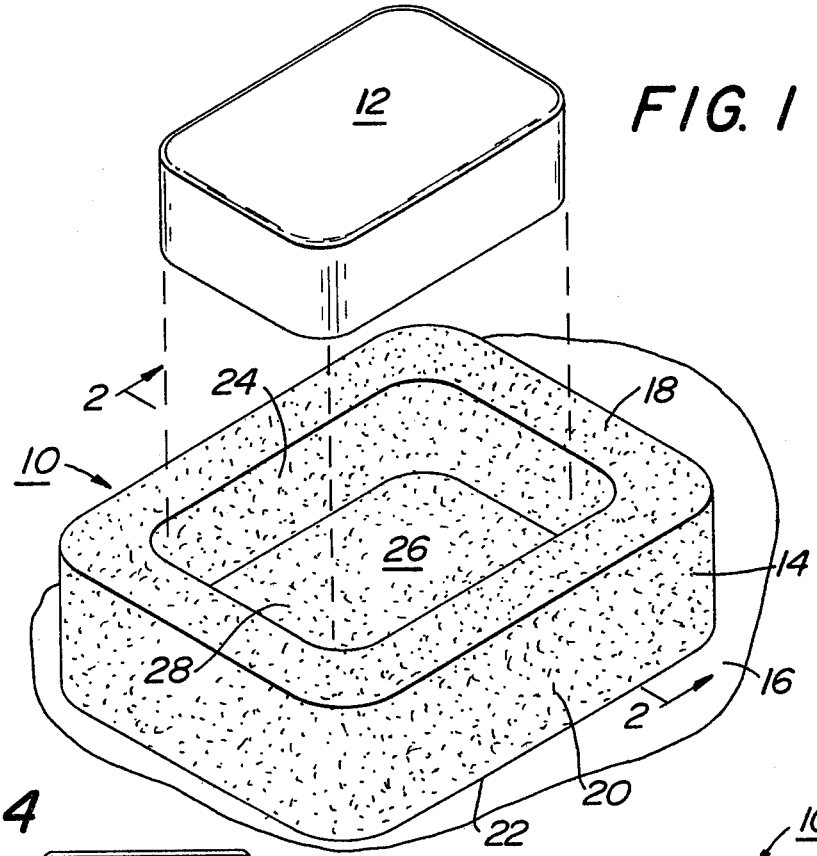
FIG. 1
FIG. 4
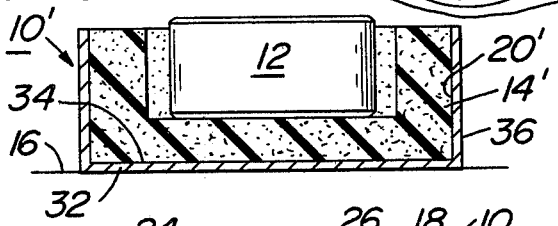
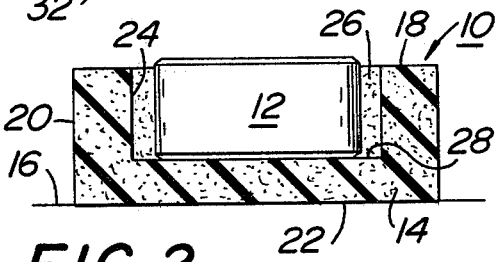
FIG. 2
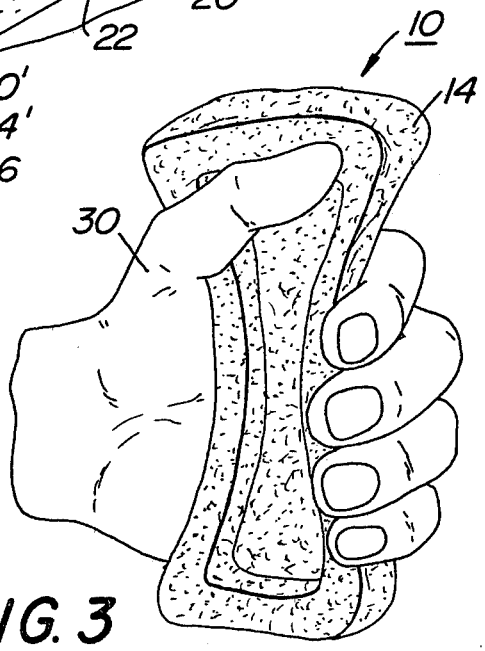
FIG. 3

SOAP DISH

BACKGROUND OF THE INVENTION

1. Field of the Invention

This invention pertains to soap dishes for containing and receiving bars of soap. In particular, this invention relates to a soap dish which is formed of an aqueous absorbing composition to maintain the bar of soap in a dry state during non-use times. More in particular, this invention relates to a soap dish which may be wrung out and easily cleaned to remove any aqueous material contained therein. More in particular, this invention pertains to a soap dish which may be cleaned and re-used over a prolonged period of time. Still further, this invention relates to a soap dish formed of a sponge or synthetic sponge material in generally one-piece formation which is easily fabricated and manufactured.

2. Prior Art

Soap dishes for releasably holding soap bars are well-known in the art. The closest prior art known to the Applicant are U.S. Pat. Nos. 2,722,719; 2,612,650; 3,019,549; 679,807; 2,255,154; 594,962; 2,241,947; 2,504,536; 618,943; and, 2,457,918. However, such prior art soap dishes are generally not directed to flexible, resilient, and aqueous absorbing composition systems.

U.S. Pat. No. 2,722,719 directs itself to a floating soap dish. The soap dish of this prior art is formed of a plastic material, however, such is stated to be expanded polystyrene, and is particularly used because of the closed cell structure, and thus does not absorb aqueous compositions.

U.S. Pat. No. 2,612,650 is directed to another type of soap container system which provides for an upper section secured to a surface. There is provided a sponge element which is transversely positioned over an inclined tray element. The sponge has a vertical slot and allows passage therethrough of a bar of soap to remove the soap of any excess lather and moisture. However, such prior art systems do not provide for the concept of the soap dish in itself being formed of an aqueous absorbing composition for containing the soap over an extended interval of time.

U.S. Pat. No. 3,019,549 is directed to another type of soap container system. In this prior art type soap container system, the sponge is separate and distinct from the tray section and is mounted below the tray section in order to catch any drippings from the soap bar.

In other prior art systems such as that shown in U.S. Pat. No. 679,807, there is provided a soap dish which is coupled or attached to a base and has openings formed therein which allow passage of soap drippings into a separate element, such as a cup.

SUMMARY OF THE INVENTION

A soap dish for releasably holding a bar of soap and including a soap retaining member. The soap retaining member is adapted to releasably contain a bar of soap therein. The soap retaining member is formed of an aqueous absorbing composition which may be compressively deformed subsequent to the aqueous absorption for removal of liquids contained within the soap retaining member.

An object of the subject invention is to provide a soap dish which increases the useful operating life of a bar of soap.

A further object of this invention is to provide a soap dish for holding bars of soap which will maintain a base surface upon which the soap holder is placed in a continuing clean condition.

A still further object of this invention is to provide a soap dish which will maintain the soap in a dry condition during the time that the soap bar is maintained in the soap dish.

Another object of this invention is to provide a soap dish which may easily be cleansed or washed.

Another object of the subject invention is to provide a soap dish for holding a bar of soap where the soap drippings may be absorbed within the soap dish and not pass to a base surface upon which the soap dish is mounted.

A still further object of this invention is to provide a soap dish which is easily fabricated and manufactured and of low cost to the consumer.

Another object of this invention is to provide a soap dish which after use may be wrung out for re-use purposes.

BRIEF DESCRIPTION OF THE DRAWINGS

FIG. 1 is an exploded perspective view of the subject invention soap dish, showing a bar of soap prior to insertion within the soap dish;

FIG. 2 is a cross-sectional view of the soap dish shown in FIG. 1, and further showing a bar of soap contained therein;

FIG. 3 is a perspective view of the soap dish being compressively deformed to remove contained matter therein; and, FIG. 4 is a cross-sectional view of the soap dish showing an impervious liquid layer mounted around the exterior surfaces of the soap dish.

DESCRIPTION OF THE PREFERRED EMBODIMENTS

Referring now to FIGS. 1–3, there is shown soap dish 10 for releasably holding and containing soap bar 12 throughout a storage time interval when soap bar 12 is not being used. Soap dish 10 is adapted to be placed on external or base surface 16 which may be a sink surface, bath tub surface, or any external surface 16 not important to the inventive concept as herein described.

In overall concept, soap dish 10 advantageously minimizes water erosion of soap bar 12 during the storage time interval. Additionally, by use of soap dish 10, soap bar 12 is maintained in a relatively dry state which has the effect of extending the useful lifetime of soap bar 12. Further, soap dish 10 effectively maintains soap bar 12 out of contact with base or external surface 16 during the storage time interval and minimizes soap drippings from adhering to base surface 16, thereby maintaining a clean surface. Aqueous drippings of soap bar 12 are absorbed within soap dish 10 and may be removed therefrom by insertion of soap dish 10 within a water solution and then compressively squeezed to remove any material which has been absorbed by soap dish 10. Soap dish 10 further allows for a reusable system which may be washed and easily cleansed for subsequent use. Still further, soap dish 10, as will herein be described, is easily manufactured and fabricated of low cost materials to provide a container for soap bar 12 which has a low overall manufacturing cost, as well as a low cost to the consumer.

Soap dish 10 is used for releasably holding soap bar 12 and comprises soap retaining member 14 which is adapted to releasably contain soap bar 12 therein. Soap retaining member 14 is generally formed of an aqueous absorbing composition, which may be compressively deformed, as is shown in FIG. 3, subsequent to aqueous absorption from the drippings of soap bar 12 in order to remove any liquids contained therein. Soap retaining member 14, as shown in FIGS. 1 and 2, is generally directed to a parallepiped volumetric outer contour, however, such may be of varying contours suitable for insertion of soap bar 12. Retaining member 14 includes upper surface 18, outer surface sidewalls 20, and lower surface 22, as is shown.

Retaining member 14 further includes recess 24 formed through upper surface 18 defining soap chamber 26 to allow for insertion of soap bar 12 within soap retaining member 14. The overall contour of soap chamber 26 is adapted to provide for insert of soap bar 12 at least partially therein and to maintain soap bar 12 remote from base surface 16 when soap bar 12 is contained therein, as is clearly shown in FIG. 2. The overall dimensions of chamber 26 is unimportant to the inventive concept as herein described, with the exception that chamber 26 should be of a size sufficient to accept and contain therein a standard soap bar 12. Thus, said chamber 26 has a predetermined volumetric contour adapted to receive soap bar 12 for purposes of containment.

In general, soap retaining member 14 is formed of a substantially porous and flexible material composition. Such compositions are generally referred to as open-celled material compositions, and retaining member 14 may be formed of a natural sponge composition for absorption purposes. Additionally, soap retaining member 14 may be formed of a synthetic sponge material composition, such as cellulose, compositions of urethane, or some like open-celled plastic based material.

Where a natural sponge composition is used in forming soap retaining member 14, recess 24 may be formed through material cutting or dissolving away portions of retaining member 14 in a manner which will provide the predetermined volume of soap chamber 26. Where a synthetic sponge material composition is used, such as an open-celled plastic composition, soap retaining member 14 may be easily molded to provide for recess 24 and soap chamber 26. In either case, soap retaining member 14 may be formed in one piece formation to provide an easily fabricated and manufactured product.

In use, subsequent to a washing operation, soap bar 12 is inserted within chamber 26. Generally, at this time, soap bar 12 is wet and interfaces with chamber lower surface 28, as is shown in FIG. 2. The contiguous interface allows for the dripping of soap bar 12 to be absorbed within soap retaining member 14. Consequently, soap bar 12 is dried and is not eroded away, which extends the overall useful life of soap bar 12. During the period of non-use of soap bar 12, soap retaining member 14 absorbs the aqueous soap drippings and maintains soap bar 12 remote from base surface 16. The user thus has a clean surface 16 and is not encumbered to remove dried soap drippings from surface 16 when soap bar 12 is removed from a storage condition.

When soap retaining member 14 is saturated with soap drippings from soap bar 12, or in the alternative, at the discretion of the user, such aqueous liquid absorbed matter may be easily removed from soap retaining member 14, as is shown in FIG. 3. The user merely compressively deforms soap dish 10 by grasping soap retainer member 14 in his or her hand 30, and squeezing out any contained liquid matter. Soap retaining member 14 may then be rinsed under tap water or some like means, and repeatedly compressed until the absorbed liquid matter is fully removed from internal soap retaining member 14. Alternatively, soap retaining member 14 may in itself be washed and cleansed and then returned to useful operation.

Referring now to FIG. 4, there is shown an embodiment of soap dish 10' which includes soap retaining member 14'. The overall formation of soap retaining member 14' is substantially identical to that shown in the preferred embodiment of FIGS. 1 and 2, however, soap retaining member 14' includes liquid impervious layer 32 formed on lower surface 34 of soap retaining member 14'. Lower liquid impervious layer 32 may be a spray-on coating of a closed cell type composition, such as a plastic coating. Alternatively, lower liquid impervious layer 32 may be formed of a polyethylene sheet which is adhesively secured or otherwise bonded to lower surface 34. The only restrictiсn directed to layer 32 being that it maintain a flexible structure to allow for compressive deformation, as is shown in FIG. 3. In this manner, all of soap bar drippings will be maintained away from base surface 16, even after a long period of storage of soap bar 12 within retaining member 14'.

In conjunction with lower liquid impervious layer 32, sidewall liquid impervious layer 36 may be secured to an outer surface of sidewall 20', as is shown in FIG. 4. Sidewall liquid impervious layer 36 may also be formed of a plastic coating, or plastic layer sheet adhesively or otherwise bonded to the outer surface of sidewall 20'. When both sidewall liquid impervious layer 36 is used in conjunction with lower liquid impervious layer 32, deformation as shown in FIG. 3 of soap retaining member 14 allows for removal of contained absorbed liquid matter within retaining member 14' through open celled surfaces 18 and the surfaces of soap chamber 26. As was the case for lower liquid impervious layer 32, sidewall liquid impervious layer 36 must have a flexible structural integrity to allow for the deformation process.

Although this invention has been described in connection with specific fcrms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A soap dish for releasably holding a bar of soap comprising a soap retaining member adapted to releasably contain a bar of soap therein, said soap retaining member being formed of an aqueous absorbing composition which may be compressively deformed subsequent to said aqueous absorption for removal of liquid contained therein, said soap retaining member including a lower surface having a liquid impervious layer formed thereon, said liquid impervious layer being resilient.

2. The soap dish as recited in claim 1 where said soap retaining member includes a recess formed through an upper surface thereof defining a soap chamber for insert of said soap bar at least partially within said soap retaining member.

3. The soap dish as recited in claim 2 where said soap chamber has a predetermined volumetric contour adapted to receive said soap bar therein.

4. The soap dish as recited in claim 2 where said soap retaining member is formed of a substantially porous and flexible material composition.

5. The soap dish as recited in claim 4 where said soap retaining member is formed of a sponge composition.

6. The soap dish as recited in claim 4 where said soap retaining member is formed of a synthetic sponge material composition.

7. The soap dish as recited in claim 2 where said soap retaining member is formed in one-piece formation.

8. The soap dish as recited in claim 2 where said soap retaining member has a structural integrity sufficient to maintain said soap bar inserted therein remote from an external base surface.

9. The soap dish as recited in claim 1 where said soap retaining member includes a lateral sidewall outer surface having a liquid impervious layer formed thereon, said liquid impervious layer being resilient.

* * * * *